US006112655A

United States Patent [19]

Suzuki et al.

[11] Patent Number: 6,112,655

[45] Date of Patent: Sep. 5, 2000

[54] STENCIL PRINTER

[75] Inventors: Masao Suzuki; Hiroyuki Sunagawa; Hiroshi Kaneda, all of Ibaraki-ken, Japan

[73] Assignee: Riso Kagaku Corporation, Tokyo, Japan

[21] Appl. No.: 09/218,092

[22] Filed: Dec. 22, 1998

[30] Foreign Application Priority Data

Dec. 24, 1997 [JP] Japan ..... 9-354809

[51] Int. Cl.[7] ..... B41L 13/14; B65H 29/68

[52] U.S. Cl. ..... 101/118; 271/182; 271/270

[58] Field of Search ..... 101/114, 116, 101/117, 118, 129; 400/582, 593, 618, 641; 271/182, 229, 270

[56] References Cited

U.S. PATENT DOCUMENTS

| | | | |
|---|---|---|---|
| 4,791,866 | 12/1988 | Kanno et al. | 101/118 |
| 4,972,207 | 11/1990 | Ishiyama et al. | 400/618 |
| 5,240,239 | 8/1993 | Kim | 271/10 |
| 5,493,968 | 2/1996 | Ishikawa | 101/118 |
| 5,678,488 | 10/1997 | Yamaguchi et al. | 101/483 |
| 5,979,311 | 11/1999 | Kakurai et al. | 101/118 |

FOREIGN PATENT DOCUMENTS 0 657 296 A1 6/1995 European Pat. Off. .

2 266 517 11/1993 United Kingdom .

*Primary Examiner*—Stephen R. Funk

*Attorney, Agent, or Firm*—Nixon Peabody LLP; Donald R. Studebaker

[57] ABSTRACT

A stencil printer includes a rotary printing drum around which the stencil master is wrapped, a main motor which rotates the printing drum, a press roller which is rotatable in parallel to the printing drum in contact with the printing drum, and a pair of opposed conveyor rollers which feed a printing paper between the printing drum and the press roller. A conveyor roller motor is provided separately from the main motor and drives the conveyor rollers. A printing drum rotation detector detects rotation of the printing drum on the basis of the reference position, and a conveyor roller rotation detector detects rotation of at least one of the conveyor rollers. A conveyor roller controller controls, when the leading end of the printing paper reaches vicinity of the contact line of the printing drum and the press roller, the conveyor roller motor to drive the conveyor rollers at a target rotating speed which is lower than the rotating speed of the printing drum detected by the printing drum rotation detector and is set so that the difference between the actual rotating speed of the conveyor roller detected by the conveyor roller rotation detector and the target rotating speed is kept substantially constant.

2 Claims, 9 Drawing Sheets

STENCIL PRINTER

BACKGROUND OF THE INVENTION

1. Field of the Invention

This invention relates to a stencil printer, and more particularly to a stencil printer in which a stencil master can be constantly held in a predetermined position on the printing drum and printing papers and the stencil master are prevented from being wrinkled.

2. Description of the Related Art

In a stencil printer, a stencil master is wrapped around a printing drum and the printing drum is rotated. A press roller in contact with the stencil master on the printing drum is rotated together with the printing drum and a printing paper is fed between the stencil master and the press roller by a paper feed mechanism. The printing paper is conveyed pinched between the stencil master and the press roller and ink supplied inside the printing drum is transferred to the printing paper through perforations in the stencil master.

In such a stencil printer, the printing paper must be fed between the printing drum and the press roller at a timing such that the printing paper exactly overlaps with the stencil master in a predetermined position relative to the stencil master. For this purpose, adjustment for ensuring that the printing paper exactly overlaps with the stencil master in a predetermined position is carried out upon starting of printing.

In conventional stencil printers, the paper feed mechanism generally comprises primary and secondary paper feed sections which are driven by the printing drum by way of a transmission mechanism such as those including gears.

The primary and secondary paper feed sections in the conventional stencil printers will be described hereinbelow.

In the primary paper feed section, printing papers stacked on a paper feed table are fed one by one for one rotation of the printing drum by a pickup roller and a scraper and conveyed to the secondary paper feed section. The pickup roller and the scraper are intermittently rotated by a main motor, which drives the printing drum, by way of a paper feed clutch which is selectively engaged and disengaged on the basis of a signal from a drum position sensor which detects the angular position of the printing drum. The pickup roller and the scraper are provided with a one-way clutch and the paper feed clutch is disengaged after the primary paper feed section delivers the leading end of the printing paper to the secondary paper feed section so that the pickup roller and the scraper run free and back tension is reduced.

In the secondary paper feed section, the leading end of the printing paper fed by the pickup roller and the scraper abuts against a guide roller or a timing roller near the contact line of the guide roller and the timing roller (will be referred to as "the conveyor roller pair", hereinbelow) which are stopped and the printing paper sags. Then the conveyor roller pair are started when the printing drum is in a predetermined phase of rotation. Each roller of the conveyor roller pair is provided with a gear on each end of its shaft and the gears on the shafts of the rollers on each end thereof are in mesh with each other. The guide roller is caused to make several rotations in one direction per one rotation of the printing drum by the main motor by way of a transmission mechanism comprising gears or an endless belt, a cam, a sector gear, a one-way clutch and the like. The timing roller is rotated in the direction opposite to the guide roller driven by the guide roller. The timing roller is moved away from the guide roller after the guide roller is stopped by a mechanism including, for instance, a cam, a cam follower, a link member and a resilient member. Further, the timing roller is provided with a spring or an electromagnetic brake on one end of its shaft so that the timing roller is stopped as soon as it is disengaged from the guide roller without overshooting under inertia.

The printing paper conveyed by the conveyor roller pair is fed between the printing drum and the press roller pressed against the printing drum at a predetermined pressure and ink supplied from an ink supply section disposed inside the printing drum is transferred to the printing paper through image-wise perforations in the stencil master while the printing paper is conveyed pinched by the printing drum and the press roller.

However since the timing roller is moved away from the guide roller upon end of conveyance of the printing paper as described above, the printing paper can run obliquely when it is delivered to the printing drum and the press roller, which can wrinkle the printing paper during subsequent conveyance of the printing paper by the printing drum and the press roller. Further there has been a problem that the printing paper is wrinkled by tensile force momentarily generated when the trailing end portion of the printing paper is caught by the pickup roller and the scraper. Wrinkle in the printing paper can wrinkle the stencil master and at the same time can shift the stencil master from the predetermined position on the printing drum.

SUMMARY OF THE INVENTION

In view of the foregoing observations and description, the primary object of the present invention is to provide a stencil printer which is free from shift of the stencil master on the printing drum and wrinkling of the printing paper and the stencil master due to unnecessary force acting on the printing paper during printing.

A stencil printer in accordance with a first aspect of the present invention comprises

- a rotary printing drum which is provided with a master clamp mechanism for holding an end of a stencil master and around which the stencil master is wrapped,
- a printing drum drive means which rotates the printing drum,
- a press roller which is rotatable in parallel to the printing drum in contact with the printing drum,
- a pair of opposed conveyor rollers which feed a printing paper between the printing drum and the press roller,
- a conveyor roller drive means which is provided separately from the printing drum drive means and drives the conveyor rollers,
- a printing drum rotation detecting means which detects the rotating speed of the printing drum,
- a conveyor roller rotation detecting means which detects the rotating speed of at least one of the conveyor rollers, and
- a conveyor roller control means which controls the conveyor roller drive means on the basis of the rotation of the printing drum detected by the printing drum rotation detecting means and the rotation of the conveyor roller detected by the conveyor roller rotation detecting means, and is characterized in that

- the conveyor roller control means controls, when the leading end of the printing paper reaches vicinity of the contact line of the printing drum and the press roller, the conveyor roller drive means to drive the conveyor rollers at a target rotating speed which is lower than the rotating speed of the printing drum detected by the printing drum rotation detecting means and is set so that the difference between the actual rotating speed of the conveyor roller detected by the conveyor roller rotation detecting means and the target rotating speed is kept substantially constant.

In the stencil printer, the conveyor roller drive means is controlled to rotate the conveyor rollers at a target speed lower than the rotating speed of the printing drum when the leading end of the printing paper reaches the contact line of the press roller and the printing drum. Even if the conveyor rollers are driven at a speed lower than the rotating speed of the printing drum, the actual rotating speed (peripheral speed) of the conveyor rollers tends to approach that of the printing drum since the conveying force of the printing drum and the press roller prevails over that of the conveyor rollers and forces the conveyor rollers to rotate at a higher speed by way of the printing paper so long as the trailing end portion of the printing paper is still between the conveyor rollers. The difference between the target peripheral speed of the conveyor rollers and the actual peripheral speed of the conveyor rollers which is substantially equal to the peripheral speed of the printing drum results in a minus torque in the conveyor roller drive means and a proper back tension is applied to the printing paper from the start of the printing to the end of the same.

Thus, the printing paper is conveyed by the printing drum and the press roller under a proper back tension and the back tension is kept substantially constant. Accordingly, the printing paper can be stably conveyed and the printing paper and the stencil master are prevented from being wrinkled. Further the stencil master can be prevented from being shifted on the printing drum due to unstable back tension.

A stencil printer in accordance with a second aspect of the present invention comprises a rotary printing drum which is provided with a master clamp mechanism for holding an end of a stencil master and around which the stencil master is wrapped, a printing drum drive means which rotates the printing drum, a press roller which is rotatable in parallel to the printing drum in contact with the printing drum, a pair of opposed conveyor rollers which feed a printing paper between the printing drum and the press roller, a conveyor roller drive means which is provided separately from the printing drum drive means and drives the conveyor rollers, a printing drum rotation detecting means which detects the rotating speed of the printing drum, a conveyor roller rotation detecting means which detects the rotating speed of at least one of the conveyor rollers, and a conveyor roller control means which controls the conveyor roller drive means on the basis of the rotation of the printing drum detected by the printing drum rotation detecting means and the rotation of the conveyor roller detected by the conveyor roller rotation detecting means, and is characterized in that the conveyor roller control means stops the conveyor roller drive means when the leading end of the printing paper reaches vicinity of the contact line of the printing drum and the press roller.

When the conveyor roller drive means is stopped, torque required to rotate the conveyor roller drive means by way of the conveyor rollers acts as load on the printing paper, whereby back tension is applied to the printing paper and the same effect as in the stencil printer of the first aspect can be obtained.

DESCRIPTION OF THE PREFERRED EMBODIMENTS

A stencil printer in accordance with an embodiment of the present invention where the present invention is applied to a stencil printer which is arranged to prevent shift of position of the printed image on a printing paper due to fluctuation in rotation of the printing drum and/or the conveyor roller pair, slip between the printing paper and the conveyor roller pair and/or shift of the stencil master from the original position on the printing drum.

Figure 1:
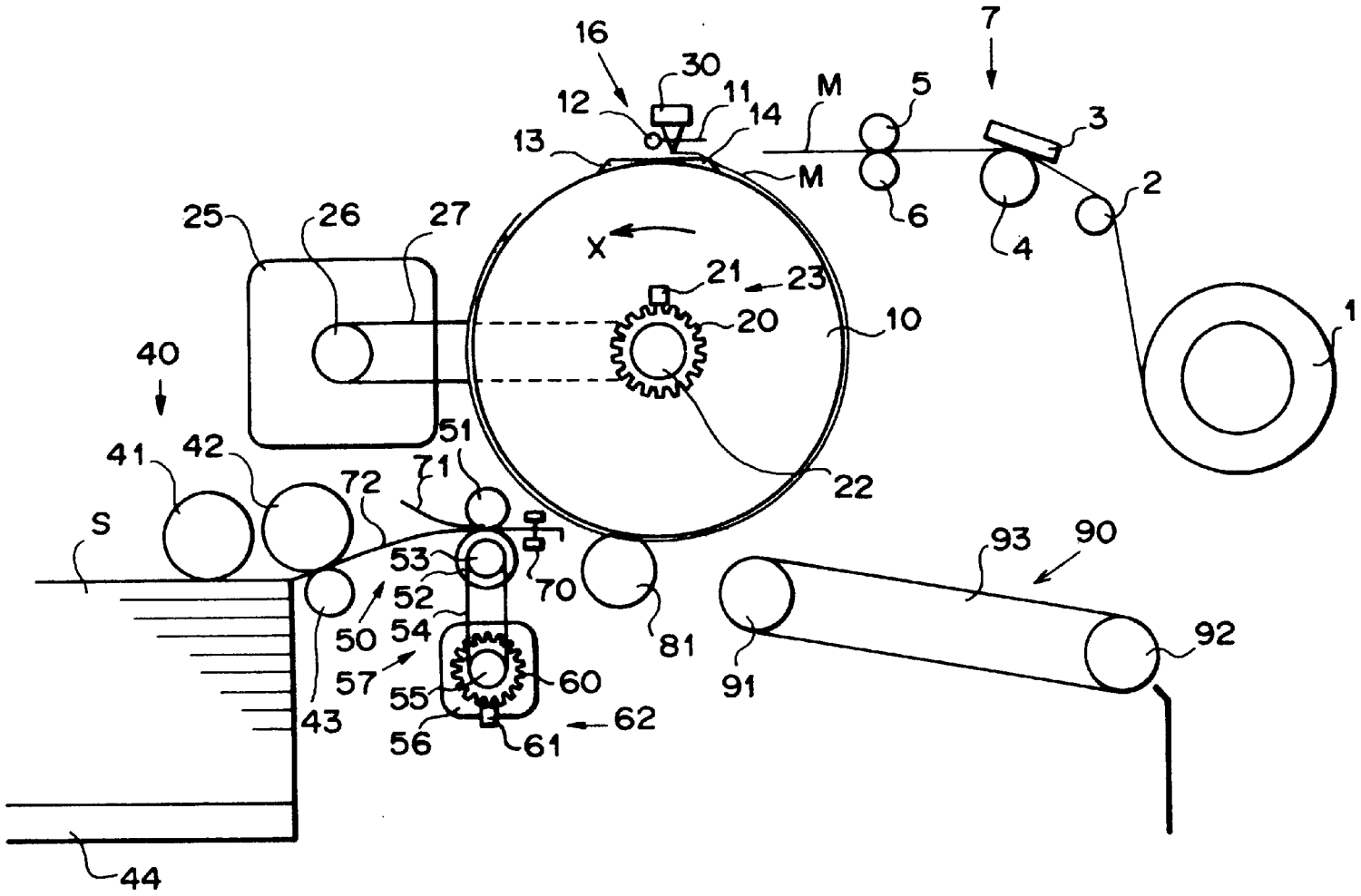
FIG. 1 is a schematic side view of a stencil printer in accordance with an embodiment of the present invention.

In FIG. 1, the stencil printer of the embodiment comprises a cylindrical printing drum 10, a press roller 81 which is pressed against the printing drum 10 and is rotatable in parallel to the printing drum 10, a primary paper feed section 40 which comprises a scraper roller 41, a pickup roller 42 and a separator roller 43 and feeds one printing paper from a stack S of printing papers on a paper feed table 44 each time the printing drum 10 makes one rotation, and a secondary paper feed section 50 which comprises a pair of register rollers 51 and 52 (conveyor roller pair), guide plates 71 and 72, and the like and inserts the printing paper, fed by the primary paper feed section 40, between the printing drum 10 and the press roller 81.

The printing drum 10 is rotated by a main motor 25 by way of a drive gear 26 formed on the output shaft of the main motor 25, a gear (not shown) formed on a rotary shaft 22 of the printing drum 10 and an endless belt 27 in mesh with the gears. A drum encoder 20 in the form of teeth formed on the circumferential surface of the rotary shaft 22 of the printing drum 10 at regular intervals and a photosensor 21 which outputs a drum pulse each time it detects one of the teeth form a printing drum rotation detecting means 23. A clamp mechanism 16 for holding the leading end of the stencil master M is provided on the printing drum 10 to extend along a generatrix of the circumferential surface thereof. A reference position detecting means (master sensor) 30 which detects a reference position on the printing drum 10 (in this particular embodiment, the leading end of the stencil master M) from which the angular position of the printing drum 10 is measured is disposed near the clamp mechanism 16 separately from the printing drum 10.

A master making section 7 which comprises a guide roll 2, a thermal head 3, a platen roller 4 and a pair of conveyor rollers 5 and 6 and makes a stencil master M by image-wise heating a master material fed from a master roll 1 is disposed near the printing drum 10.

Figure 2:
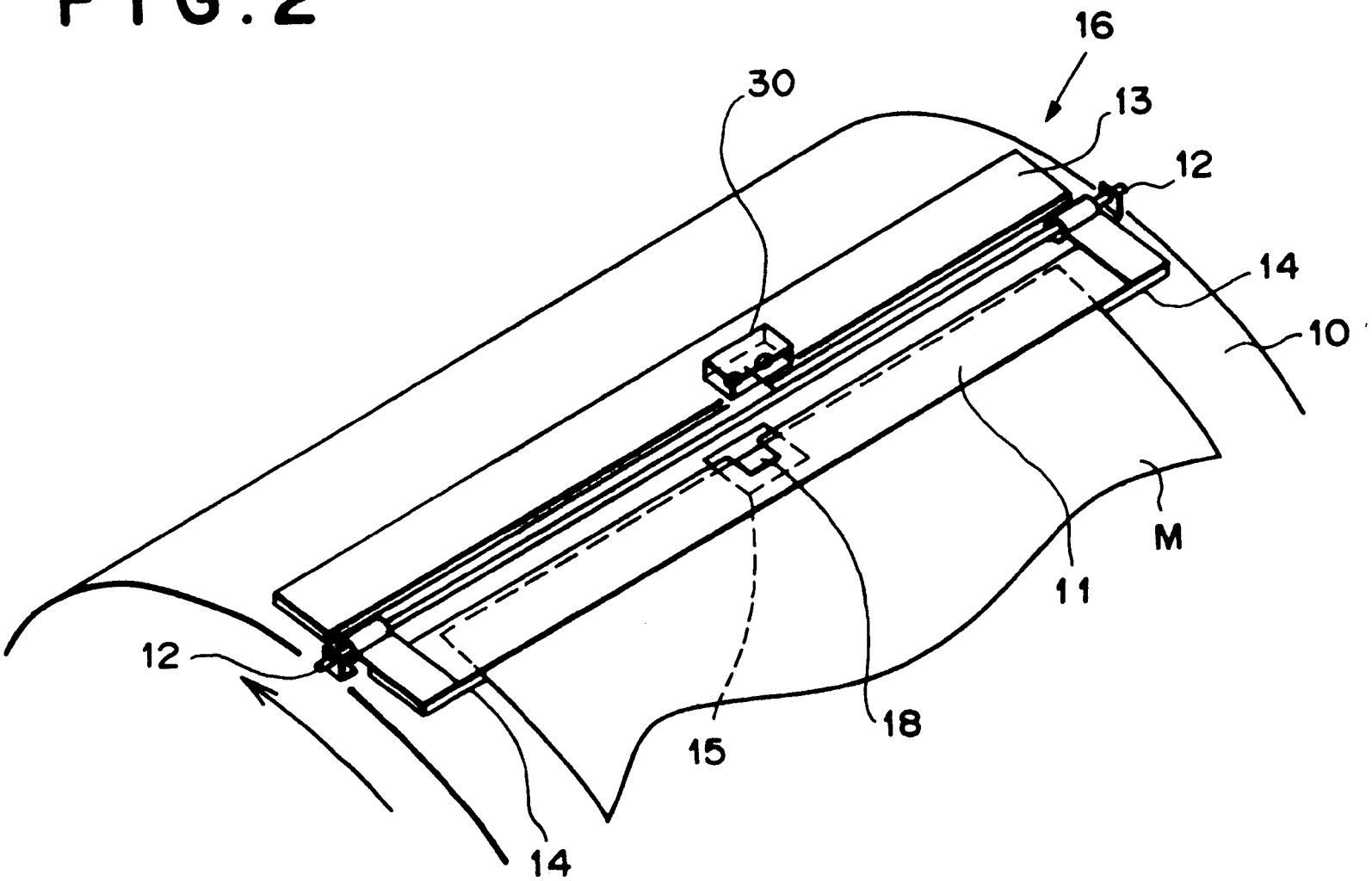
FIG. 2 is an enlarged perspective view showing in detail the clamp mechanism and the master sensor.

As shown in detail in FIG. 2, the clamp mechanism 16 comprises a magnetic clamp plate 11 fixed to a rotary pin 12 which extends along a generatrix of the printing drum 10 and is supported for rotation at opposite ends thereof, and a pair of retainer plates 13 and 14 which hold the clamp plate 11 under the magnetic force of the clamp plate 11 respectively in a clamping position or a closing position where the clamp plate 11 pinches the leading end of the stencil master M together with the retainer plate 14 and an opening position where the clamp plate 11 releases the stencil master M. A monitor window 18 is formed in the clamp plate 11 at a middle portion thereof. An anti-reflective region 15 is formed around the monitor window 18. The master sensor 30 comprises an LED and a photosensor and the photosensor receives light emitted from the LED and reflected at the surface of the leading end portion of the stencil master M, thereby detecting the leading end of the stencil master M. The anti-reflective region 15 prevents irregular reflection of the light emitted from the LED.

The register rollers 51 and 52 are interlocked with each other to rotate together in opposite directions by way of gears which are formed on opposite ends of the respective rollers and are in mesh with each other at each end. The register roller 52 is driven by a register roller drive means 57 comprising a register motor 56, a gear 53 formed on the rotating shaft of the register roller 52, a gear (not shown) formed on the output shaft 55 of the register motor 56 and an endless belt 54 in mesh with the gear 53 on the register roller 52 and the gear on the output shaft 55. A register encoder 60 in the form of teeth formed on the circumferential surface of the output shaft 55 of the register motor 56 at regular intervals and a photosensor 61 which outputs a register pulse each time it detects one of the teeth form a register roller rotation detecting means 62 which detects information on rotation of the register roller 52 by way of information on rotation of the register motor 56. Preferably the register motor 56 is a DC servomotor.

Figure 3:
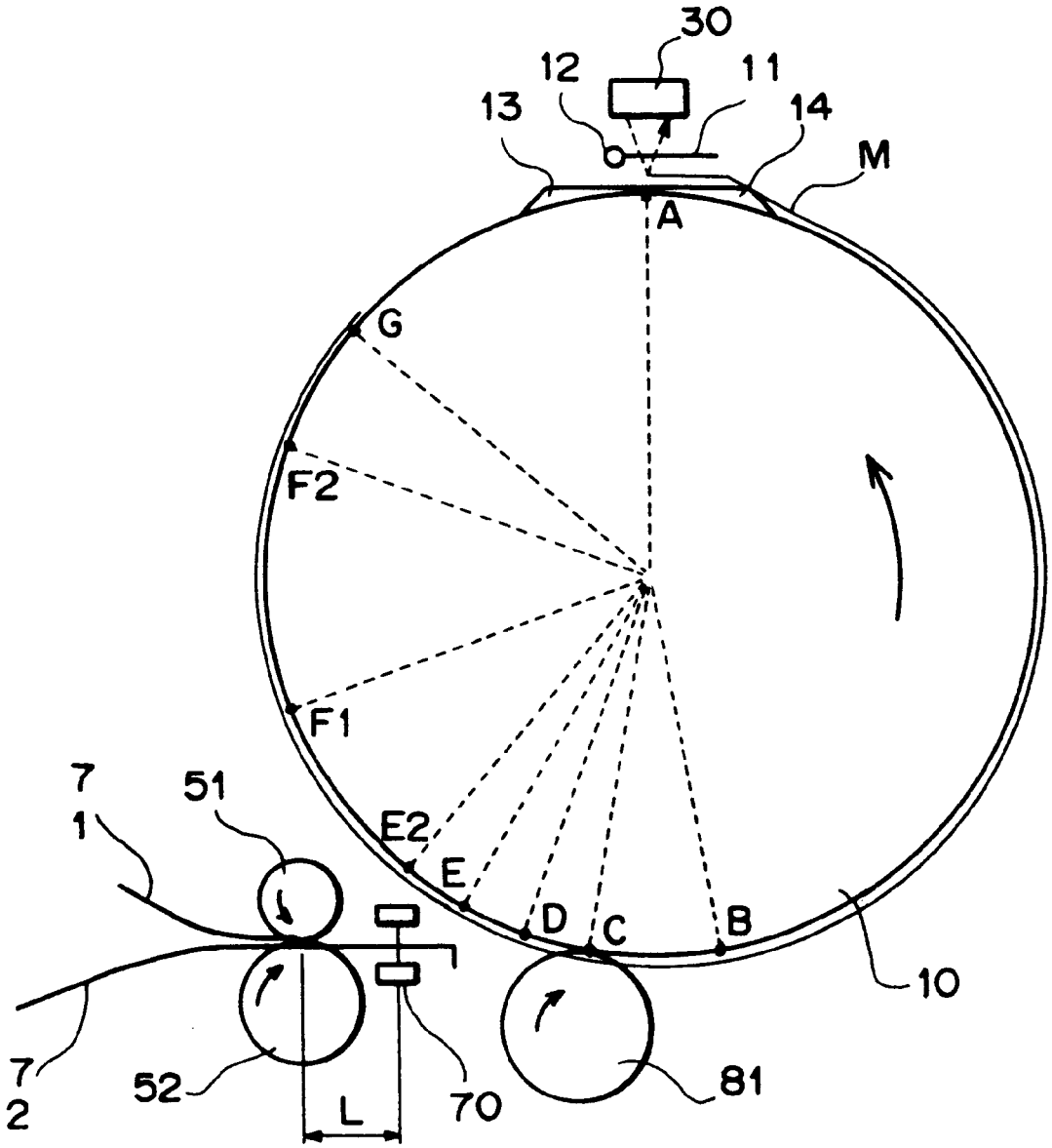
FIG. 3 is a fragmentary side view showing an important part of the stencil printer.

Between the register rollers 51 and 52 and the press roller 81, there is disposed a register sensor (paper end detecting means) 70 which detects the leading end (as seen in the direction of conveyance of the printing paper) of the printing paper at a predetermined distance L from the register rollers 51 and 52 downstream thereof as shown in FIG. 3.

The stencil printer of this embodiment is provided with a control means 170 (FIG. 4) which controls a motor drive circuit 160 (FIG. 4) for driving the register motor 56 on the basis of drum rotation information detected by the printing drum rotation detecting means 23 and register roller rotation information detected by the register roller rotation detecting means 62.

On the downstream side of the press roller 81 as seen in the direction of conveyance of the printing paper, there is disposed a paper discharge section 90 which stacks printed papers removed from the printing drum 10. The paper discharge section 90 comprises a pair of suction rollers 91 and 92 and a suction belt 93 passed around the suction rollers 91 and 92.

Figure 4:
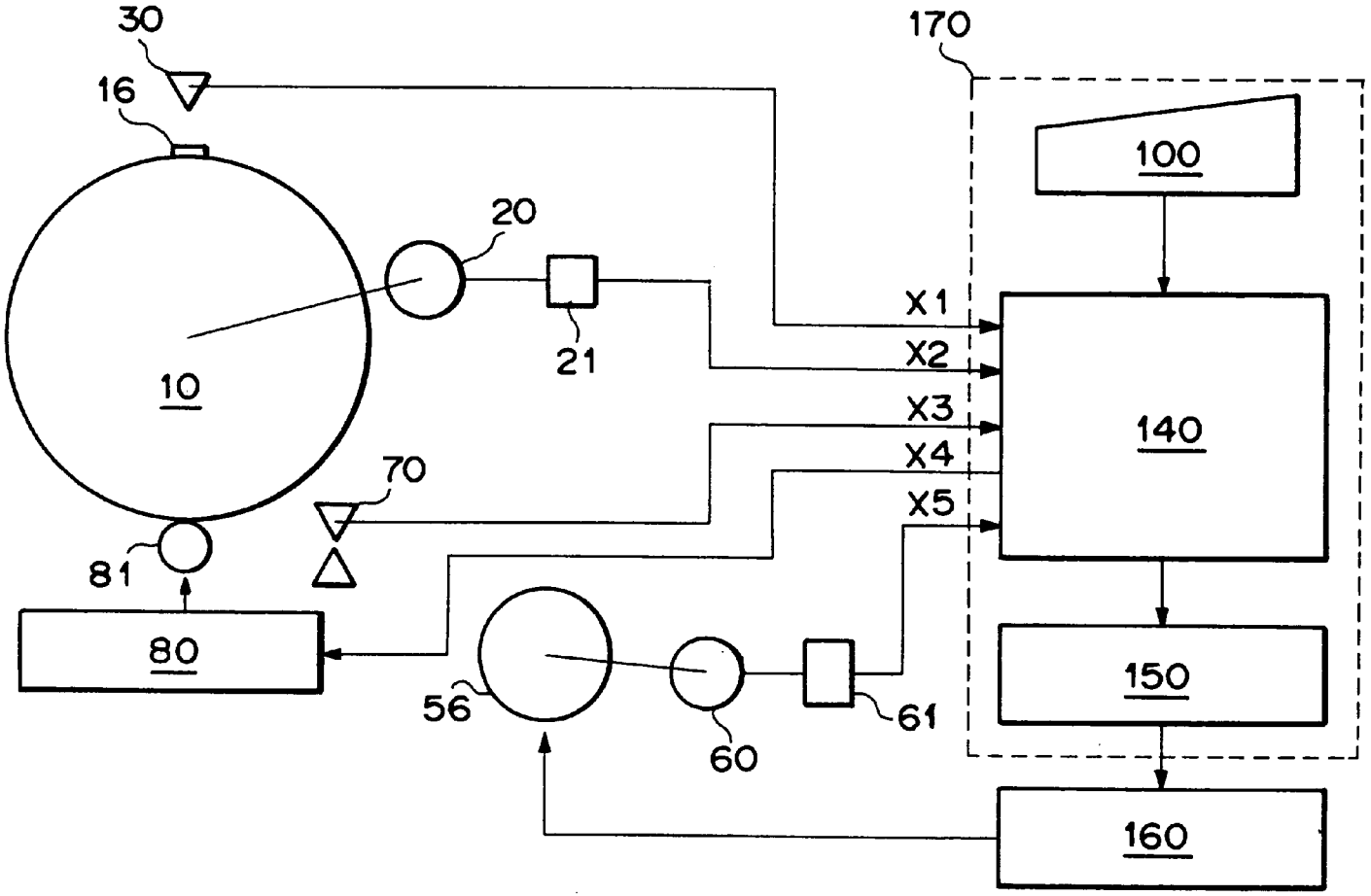
FIG. 4 is a block diagram showing the control means of the stencil printer.

FIG. 4 schematically shows the arrangement of the stencil printer of this embodiment. The control means 170 may comprise, for instance, a CPU which executes various processings described later. Drum pulses X2 output from the photosensor 21 of the printing drum rotation detecting means 23 and a reference pulse X1 output from the master sensor 30 upon detection of the leading end of the stencil master M are input into a motor control circuit 140. The reference pulse X1 is detected each time the printing drum 10 makes one rotation and the number of the drum pulses X2 is counted from the time the reference pulse X1 is detected. That is, the number of the drum pulses X2 represents the angular position or the rotation-phase position of the printing drum 10. Register pulses X5 output from the photosensor 61 of the register roller rotation detecting means 62 representing the rotation of the register motor 56, that is, the register rollers 51 and 52 are also input into the motor control circuit 140.

In the motor control circuit 140, the value NB of count of the drum pulses X2 at which the register motor 56 is to be started (this value NB will be referred to as "the register motor starting count NB", hereinbelow) is set in advance and the number of the drum pulses X2 reaches the register motor starting count NB, a PWM (pulse width modulator) signal generator 150 is started. The register motor starting count NB can be changed through a control panel 100. The PWM signal generator 150 starts the register motor 56 by way of the motor drive circuit 160, thereby driving the register rollers 51 and 52 to convey the printing paper. Thus the timing at which the leading end of the printing paper is to be inserted between the printing drum 10 and the press roller 81 can be controlled by changing the register motor starting count NB. In other words, the position of the printing paper relative to the stencil master M (will be referred to as "longitudinal registration" hereinbelow) in which the printing paper is brought into contact with the stencil master M can be controlled by changing the register motor starting count NB. Further since the number of the drum pulses X2 is counted from the position of the leading end of the stencil master M, the position of the printing paper relative to the stencil master M can be kept unchanged even if the leading end of the stencil master M is shifted relative to the printing drum 10 in the direction opposite to the direction of rotation of the printing drum 10. Further the motor control circuit 140 watches the register pulses X5 and controls the motor drive circuit 160 so that the rotating speed of the register motor 56 is kept in a predetermined relation (to be described later) with the rotating speed of the printing drum 10.

A paper end pulse X3 which is output from the register sensor 70 upon detection of the leading end of the printing paper is also input into the motor control circuit 140. When the paper end pulse X3 is not detected by a predetermined time, which occurs when slip of the printing paper occurs during conveyance, the motor control circuit 140 controls the register motor 56 by way of the motor drive circuit 160 so that the delay in conveyance of the printing paper due to slip is compensated for and the printing paper meets the stencil master M in the preset position relative to the stencil master M. Thus shift of the printing paper relative to the stencil master M due to slip of the printing paper during conveyance, which cannot be dealt with by simply controlling the rotating speed of the register roller 51 and 52 relative to the rotating speed of the printing drum 10, can be prevented as will be described in more detail later. Such a control of the register motor 56 will be referred to as "the slip compensation control", hereinbelow.

The operation of the stencil printer of this embodiment will be described with reference to Figures 5 to 11, hereinbelow.

First the master making process will be described. In the master making section 7 (FIG. 1), the master material is fed out from the master roll 1 and conveyed between the thermal head 3 and the platen roller 4 guided by the guide roller 2. While the master material travels between the thermal head 3 and the platen roller 4, the thermal head 3 image-wise heats the master material according to an image signal input from an image read-out section (not shown), thereby making a stencil master M. At this time, the conveyor rollers 5 and 6 are kept stopped and the stencil master M is temporarily stored in a storage box (not shown) disposed between the conveyor rollers 5 and 6 and the thermal head 3.

Then the printing drum 10 is rotated to the master mounting position shown in FIG. 1 and the clamp plate 11 is moved to the opening position where it is on the retainer plate 13. In this state, the conveyor rollers 5 and 6 are started to convey the stencil master M. The conveyor rollers 5 and 6 are driven by a stepping motor (not shown) and the stepping motor is driven by a predetermined number of pulses so that the leading end of the stencil master M is stopped in a predetermined position. After the leading end of the stencil master M is stopped in the predetermined position, the clamp plate 11 is rotated to the clamping position where it abuts against the retainer plate 14 with the leading end portion of the stencil master M pinched therebetween. Then the main motor 25 is energized to rotate the printing drum 10 in the direction of arrow X at a low speed and when the printing drum 10 is rotated by a predetermined angle, the stencil master M is severed from the master material in a continuous length, whereby the stencil master M is wrapped around the printing drum 10. The master sensor 30 detects the leading end of the stencil master M through the monitor window 18 in the clamp plate 11.

Figure 6:
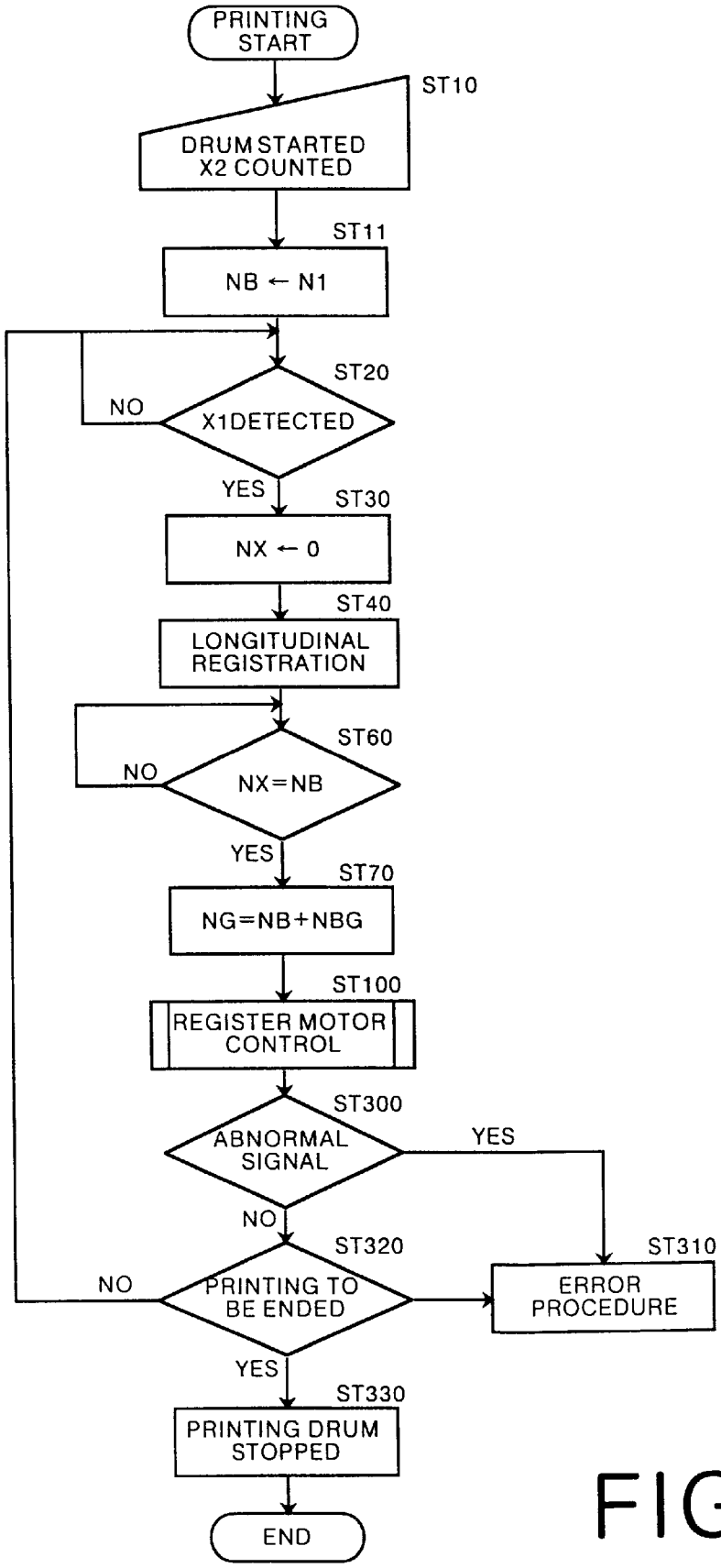
FIG. 6 is a flow chart for illustrating the main processing to be executed by the control means.

The printing operation of the stencil printer of this embodiment will be described with reference to the flow chart shown in FIG. 6, hereinbelow.

The main motor 25 is started to rotate the printing drum 10 and count of the drum pulses X2 is started (step ST10), and then the register motor starting count NB is set to a standard value N1 (step ST11). When a reference pulse X1 from the master sensor 30 is detected, that is, when the leading end of the stencil master M is in position A (FIG. 3) just below the master sensor 30, the count NX of the drum pulses X2 is once cleared. (steps ST20 and ST30) Then count of the drum pulses X2 is resumed. That is, the position of the leading end of the stencil master M is set as a reference position on the basis of which the angular position and the rotating speed of the printing drum 10 are measured. The angular position of the printing drum 10 can be known as the number of the drum pulses X2 detected after detection of reference pulse X1 output from the master sensor 30 and the rotating speed of the printing drum 10 can be known from the period of one drum pulse X2. By detecting the angular position of the printing drum 10 in this manner, the position of the printing paper relative to the stencil master M, i.e., "longitudinal registration", can be kept as set initially even if the stencil master M is shifted from the original position during printing.

The register motor starting count NB which governs the longitudinal registration can be changed by inputting an adjustment value through the control panel 100 as described above. Step ST 40 (the longitudinal registration) is executed only when an adjustment value is input through the control panel 100 and is normally passed.

In response to start of the main motor 25 (step ST 10), the primary paper feed section 40 is driven by the main motor 25 by way of a transmission mechanism which is not shown and may be of the conventional structure and the uppermost printing paper in the stack S of the printing papers is separated from the stack S and is brought into abutment against the contact line of the register rollers 51 and 52 which are kept stopped at this time, whereby the printing paper sags along the guide plate 71.

When the count NX of the drum pulses X2, that is, the number of the drum pulses X2 counted from the time the reference pulse X1 is detected, reaches the register motor starting count NB (step ST60), the register motor 56 is started to rotate the register rollers 51 and 52. In FIG. 3, when the printing drum 10 is rotated by an angle corresponding to arc AB after detection of the reference pulse X1 (when the point on the printing drum 10 which is in position B when the leading end of the stencil master M is in the position A reaches the position A: this time point will be referred to as "time point B", hereinbelow), the register motor 56 is started to rotate the register rollers 51 and 52. That is, the register motor starting count NB corresponds to rotation of the printing drum 10 which carries the leading end of the stencil master M to a position distant from the position A in the counterclockwise direction by an angle equal to the angle corresponding to arc AB. When the printing drum 10 is rotated by the angle corresponding to arc BG after the time point B, the register motor 56 is stopped. The number of the drum pulses X2 corresponding to rotation of the printing drum 10 by the angle corresponding to arc BG will be referred to as "the operating count NBG", hereinbelow. The register motor starting count NB is variable as described above whereas the operating count NBG is generally fixed. In step ST70, the sum of the register motor starting count NB and the operating count NBG is set as a register motor stopping count NG at which the register motor 56 is to be stopped. Then the register motor 56 is controlled so that rotation of the register rollers 51 and 52 are synchronized with rotation of the printing drum 10, that is, so that the register rollers 51 and 52 are in a predetermined relation with the printing drum 10 with respect to the rotating speed and the angular position (step ST100: the register motor control sub-routine shown in FIGS. 7 and 8 to be described later) This processing is continued until the count NX of the drum pulses X2 reaches NF1 corresponding to rotation of the printing drum 10 by the angle corresponding to arc AF1 (FIG. 3), when the leading end of the printing paper reaches the contact line of the printing drum 10 and the press roller 81.

When the leading end of the printing paper reaches the contact line of the press roller 81 and the printing drum 10, the printing paper comes to be conveyed pinched by the press roller 81 and the printing drum 10. While the printing paper is conveyed by the press roller 81 and the printing drum 10, ink supplied from an ink supply section inside the printing drum 10 (not shown) is transferred to the printing paper through the stencil master M, whereby printing is effected. When the count NX of the drum pulses X2 reaches the register motor stopping count NG (step ST204-YES), the register motor 56 is stopped as will be described later with reference to FIG. 8. In this embodiment, the register motor 56 is controlled to rotate the register rollers 51 and 52 at a target speed lower than the rotating speed of the printing drum 10 when the leading end of the printing paper reaches the contact line of the press roller 81 and the printing drum 10. Even if the register rollers 51 and 52 are driven at a speed lower than the rotating speed of the printing drum 10, the actual rotating speed (peripheral speed) of the register rollers 51 and 52 tends to approach that of the printing drum 10 since the conveying force of the printing drum 10 and the press roller 81 prevails over that of the register rollers 51 and 52 and forces the register rollers 51 and 52 to rotate at a higher speed by way of the printing paper so long as the trailing end portion of the printing paper is still between the register rollers 51 and 52. The difference between the target peripheral speed of the register rollers 51 and 52 and the actual peripheral speed of the register rollers 51 and 52 which is substantially equal to the peripheral speed of the printing drum 10 results in a minus torque in the register motor 56 and a back tension is applied to the printing paper.

Thus in this embodiment, the printing paper is conveyed by the printing drum 10 and the press roller 81 under a back tension and the back tension is kept substantially constant as will be described in more detail later.

Figure 8:
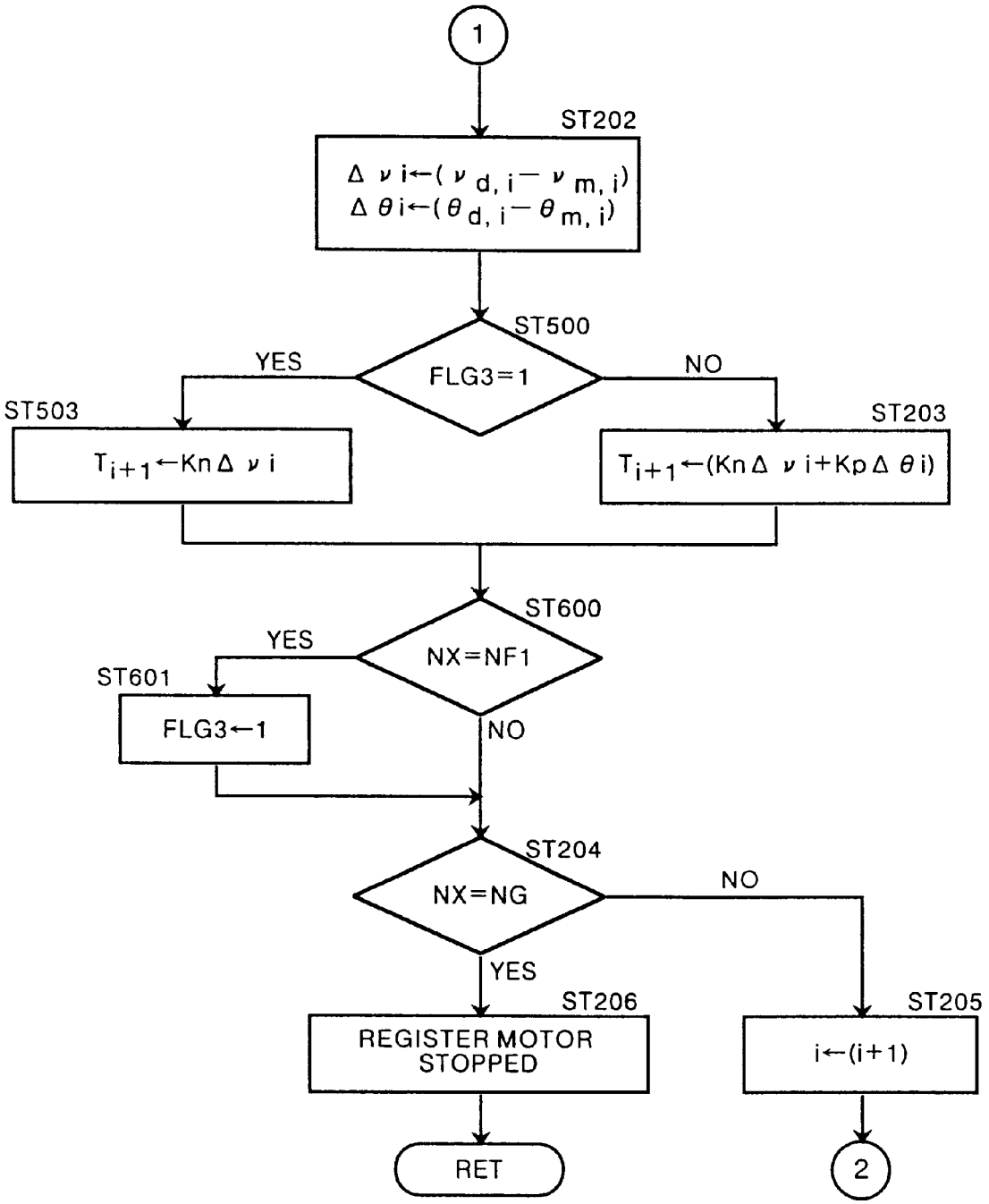

When the trailing end of the printing paper is released from the register rollers 51 and 52 which corresponds to the time point at which the point on the printing drum 10 which is in position F2 when the leading end of the stencil master M is in the position A reaches the position A, the register motor 56 comes to rotate at the target speed and is stopped when the drum count NX becomes equal to the register motor stopping count NG (step ST206 in FIG. 8).

When an abnormal signal is generated during the register motor control sub-routine as will be described later, a press roller solenoid 80 (FIG. 4) is actuated to move the press roller 81 away from the printing drum 10 and the register rollers 51 and 52 are kept rotated to discharge the printing paper (error procedures), steps ST300 and ST310). Thereafter the printing drum 10 is stopped (step ST330). This is because if the printing operation is continued despite that no printing paper reaches the press roller 81, the press roller 81 is stained with ink. It is preferred that a warning be provided as a display on the control panel 100 and/or sound.

The printed paper is peeled off the printing drum 10 by a scraper (not shown) disposed between the suction roller 91 and the printing drum 10 and conveyed by the suction belt 93 to be stacked in the paper discharge section 90.

These steps are repeated until a predetermined number of printing papers are printed (step ST320) and thereafter the printing drum 10 is stopped (step ST330).

The register motor control sub-routine (step ST100) will be described in detail with reference to FIGS. 5, 7 and 8, hereinbelow.

Figure 5:
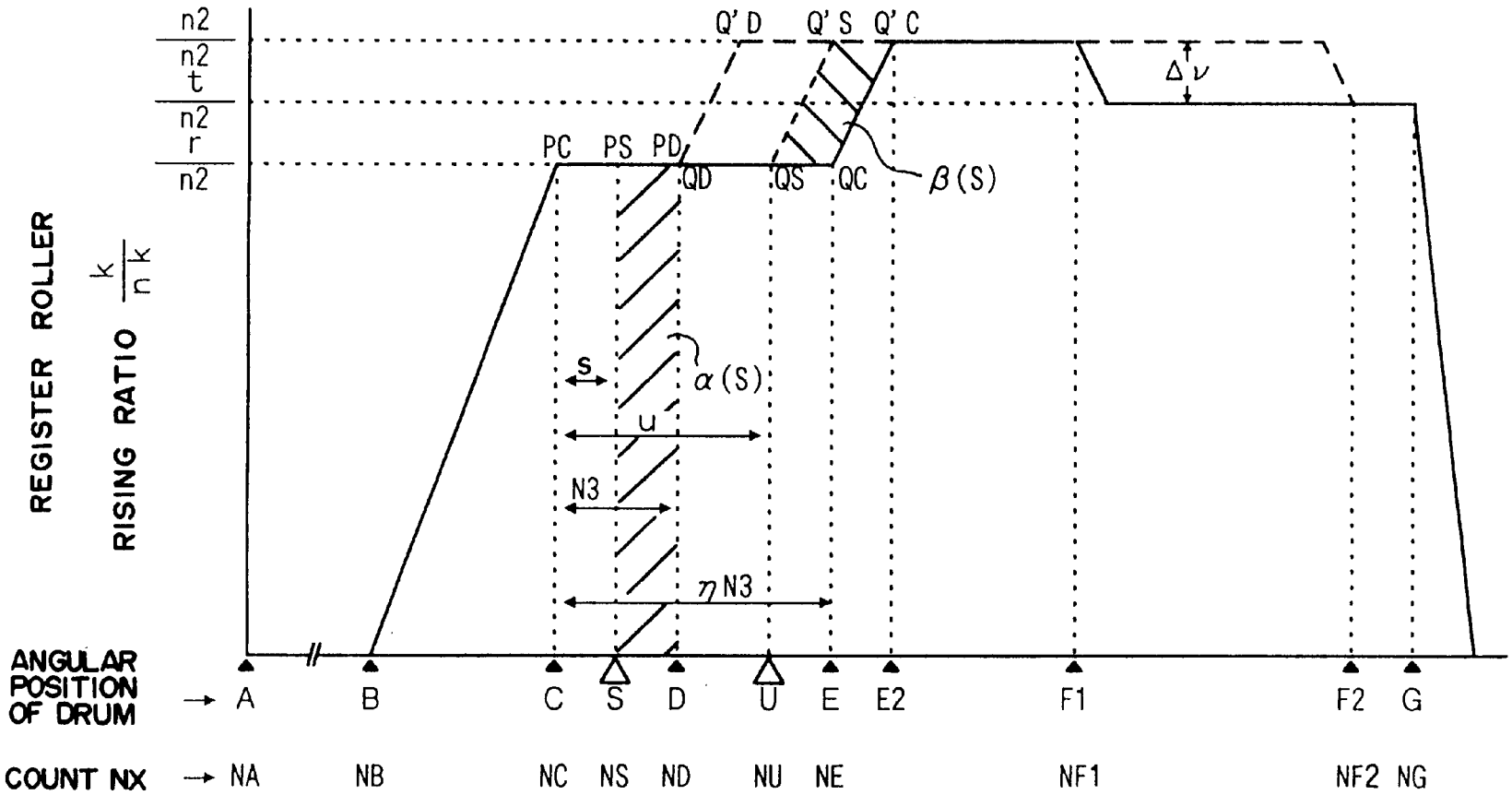
FIG. 5 is a chart for illustrating the operation of the stencil printer.

In this sub-routine, the register motor 56 is started when the count NX of the drum pulses X2 reaches the register motor starting count NB, is caused to rise to the rotating speed of the printing drum 10 in a plurality of steps (first to n2-th steps) and then is decelerated to a target speed lower than the rotating speed of the printing drum as shown in FIG. 5. The register motor 56 is first caused to rise to r-th step at a time point the printing drum 10 is rotated by the angle corresponding to arc BC (FIG. 3) after the time point B, and the rotating speed of the register motor 56 is kept constant at the rotating speed in the r-th step. In FIG. 5, angular positions C, S, D, U, E, E2, F1 and G of the drum respectively correspond to angular positions of the printing drum 10 at time points the printing drum 10 is rotated by the angles C-B, S-B, D-B, U-B, E-B, E2-B, F1-B, F2-B and G-B after the time point B, and the time points corresponding to angular positions C, S, D, U, E, E2, F1, F2 and G of the drum will be sometimes referred to as "time point C", "time point S", "time point D", time point U", "time point E", "time points E2", "time point F1", "time point F2" and "time point G", hereinbelow.

Then when the count NX reaches a predetermined value, the register motor 56 is re-accelerated to rise to the rotating speed of the printing drum 10 in (n2−r) steps. The predetermined value of the count NX is changed according to the time or the value of the count NX at which the paper end pulse X3 is detected to compensate for delay in conveyance of the printing paper due to slip (the aforesaid "slip compensation control"). For example, when the paper end pulse X3 is detected at time point C, the register motor 56 is re-accelerated at time point E and is caused to rise to the rotating speed of the printing drum 10 at time point E2. The time point C has been set so that when the printing paper is conveyed without slip, the leading end of the printing paper reaches the register sensor 70 at the time point C, and the time point E has been set so that the printing paper can meet the stencil master M in the preset position relative to the stencil master M when the register motor 56 is re-accelerated at the time point E so long as the leading end of the printing paper has reached the register sensor 70 at the time point C. Accordingly when the paper end pulse X3 is detected after the time point C, the register motor 56 is re-accelerated before the time point E in order to compensate for the delay as will be described in detail later.

Further when the leading end of the printing paper reaches the contact line of the printing drum 10 and the press roller 81, i.e., the time point F1 in FIG. 5, the register motor 56 is decelerated to a predetermined target value.

The number of the steps in which the register motor 56 is caused to rise to the rotating speed of the printing drum 10 will be referred to as "the number of rising steps nk" and is set to n2 (e.g., 15). The number of the steps by which the register motor 56 has risen at a given time will be referred to as "the current number of rising steps k" and is incremented one by one in the range of 1 to n2. The step at which the rotating speed of the register motor 56 is kept constant for the purpose of the slip compensation control will be referred to as "the watching step Cr" and is represented in terms of the number of steps by which the register motor 56 has risen (the current number of rising steps k).

Figure 7:
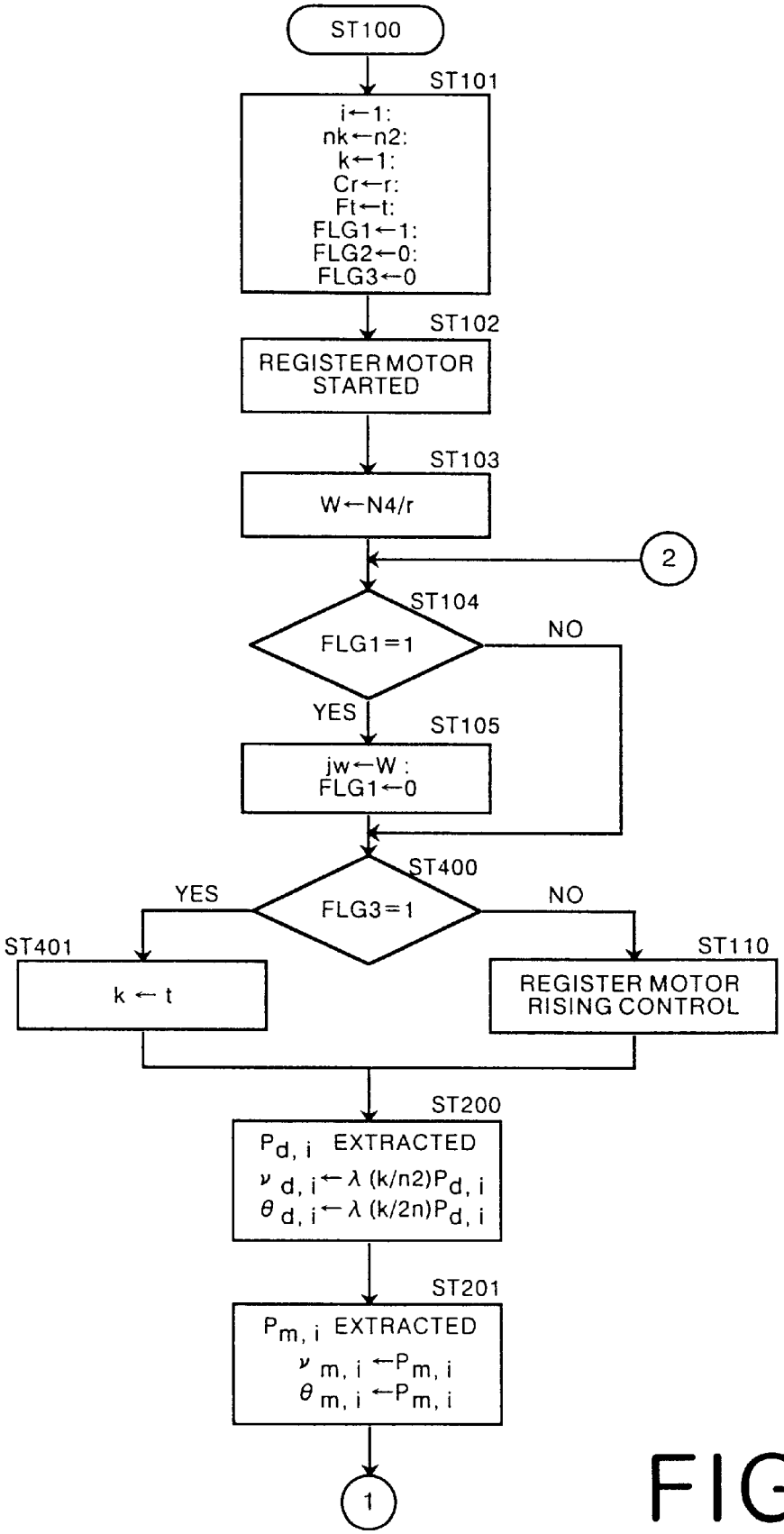
FIGS. 7 and 8 show a flow chart for illustrating the register motor control processing.

In the sub-routine shown in FIG. 7, step ST101 is an initialization step in which the number of drum pulses i counted from the time point B is set to 1, the number of the rising steps nk is set to n2, the current number of rising steps k is set to 1, the watching step Cr is set to r (e.g., 13), rising flag FLG1, which is for incrementing the current number of rising steps k one by one, is set to 1, and register flag FLG2 is set to 0. The register flag FLG2 represents that the leading end of the printing paper has not been detected by the register sensor 70, i.e, the paper end pulse has not been detected, when it is 0, and that the leading end of the printing paper has been detected by the register sensor 70, i.e, the paper end pulse has been detected, when it is 1. Further arrival flag FLG3 is set to 0. The arrival flag FLG 3 represents that the leading end of the printing paper has reached the contact line of the printing drum 10 and the press roller 81 when it is 1 and that the leading end of the printing paper has not reached the contact line when it is 0.

The rising flag FLG1 is set to 1 when the count of a backward counter, which is decremented from rising width count jw (the number of the drum pulses X2 corresponding to the period in which the register motor 56 rises by one step) one by one each time one drum pulse X2 is detected, becomes 0, and when the rising flag FLG1 is set to 1, the current number of rising steps k is incremented by one and the rising flag FLG1 is set to 0 to reset the backward counter. Specifically the value W of the rising width count jw is obtained by dividing the value of the number of drum pulses i at the time point C (FIG. 5) (N4=NC−NB) by the value r of "the watching step Cr", that is, W=N4/r.

After the initialization step ST101, the register motor 56 is started (step ST102), and then the value W of the rising width count jw is set to N4/r (step ST103).

Then, so long as the arrival flag FLG3 is not equal to 1 (step ST400), register motor rising control is executed (step ST110) immediately when the rising flag FLG1 is 0 (step ST104: NO) and after resetting the rising width count jw to W and resetting the rising flag FLG1 to 0 (step ST105) when the rising flag FLG1 is 1 (step ST104: YES). When the leading end of the printing paper reaches the contact line of the printing drum 10 and the press roller 81 (the time point F1) and the arrival flag FLG3 is turned to 1, rotating speed setting control for setting the rotating speed of the register motor 56 to a target speed at which the peripheral speed of the register rollers 51 and 52 is lower than that of the printing drum 10 is executed in step ST401. In this step, the rotating speed of the register motor 56 is lowered to a target speed at t–th step (FIG. 5) in the rising steps (k=t).

In the register motor rising control, the register motor 56 is caused to rise to the watching step Cr while the current number of rising steps k is incremented one by one. When the current number of rising steps k becomes equal to r (the watching step Cr), the aforesaid slip compensation control is executed.

In FIG. 5, in the slip compensation control, when the paper end pulse X3 is detected at time point C, the register motor 56 is re-accelerated at time point E and is caused to rise to the rotating speed of the printing drum 10 at time point E2. The time point C has been set so that when the printing paper is conveyed without slip, the leading end of the printing paper reaches the register sensor 70 at the time point C, and the time point E has been set so that the printing paper can meet the stencil master M in the preset position relative to the stencil master M when re-acceleration of the register motor 56 is started at the time point E so long as the leading end of the printing paper has reached the register sensor 70 at the time point C. A point PC of the register motor rising line corresponding to the time point C will be referred to as "the reference detecting point" and a point QC corresponding to the time point E will be referred to as "the reference re-accelerating point". For example when the paper end pulse X3 is detected at a time point S, the register motor 56 is re-accelerated at a time point U in order to compensate for the number s of drum pulses by which detection of the paper end pulse X3 is delayed behind the reference detecting point PC (the amount of delay in conveyance of the printing paper). A point PS corresponding to the time point S will be referred to as "the actual detecting point" and a point QS corresponding to the time point U will be referred to as "the re-accelerating point". In this case, the re-accelerating point is advanced from the reference re-accelerating point QC by the number of the drum pulses ηN3-u, N3 being the number of the drum pulses between the time points c and D, u being the number of the drum pulses between the time points C and U and η being the ratio of the space between the reference detecting point PC and a limit detecting point PD to the space between the reference detecting point PC and the reference re-accelerating point QC. When the paper end pulse X3 is detected after a time point D, the delay in conveyance of the printing paper cannot be compensated for. Accordingly the point PD corresponding to the time point D will be referred to as "the limit detecting point".

In the slip compensation control, when the paper end pulse X3 is detected, the re-accelerating point QS is calculated according to the time point at which the paper end pulse X3 is detected.

The space between the reference detecting point PC and the limit detecting point PD (the space between the time points C and D) is N3 (=ND−NC) in terms of the number of the drum pulses. The space between the reference detecting point PC and the reference re-accelerating point QC (the space between the time points C and E) is ηN3 in terms of the number of the drum pulses. Due to difference in the rotating speed between the printing drum 10 and the register motor 56, rotation of the register motor 56 lags behind the printing drum 10 by a distance of 1−(r/nk) pulses per one drum pulse. That is, in order for the register motor 56 to catch up with the printing drum 10, 1/(1−(r/nk) register pulses are required per one drum pulse. On the basis of this relation, a maximum amount of acceptable delay, that is, the space between the reference detecting point PC and the limit detecting point PD can be determined in terms of the number of the drum pulses. Thus the time point D can be determined and the time point E can be determined on the basis of the time point D and η.

When the paper end pulse X3 is detected at a time point S with a delay of s drum pulses (=NS−NC), the register motor 56 is caused to rise from a time point U along line QS–Q'S. The area of rectangle C-S-PS-PC represents the amount of slip of the printing paper between the time points B and C. That is, the area of rectangle C-D-PD-PC is equal to α(S)+β(S) and constant, wherein α(S) represents the area of rectangle S-D-PD-PS and β(S) represents the area of quadrangle QS-QC-Q'C-Q'S. Thus the number of drum pulses X between the time points U and E is determined as (η−1)s and the value NU of count NX at the time point U (corresponding to the re-accelerating point QS) is determined as u+NC, wherein u=ηN3−(η−1)s.

When the paper end pulse X3 is detected after the time point D corresponding to the limit detecting point PD, error procedure is executed. Otherwise, when the drum counts NX reaches NU, the register motor 56 is re-accelerated.

By adjusting the re-accelerating point according to the amount of delay of conveyance of the printing paper, the leading end of the printing paper can meet the printing drum 10 constantly in the desired position, whereby position shift of the printing paper due to slip between the printing paper and the register rollers 51 and 52 can be prevented.

After the register motor rising control (ST110) or the target speed setting control (ST401), the width of the drum pulse $P_{d,i}$ (=X2) is converted to the width of the register pulse $P_{m,i}$ (=X5). (steps ST200 and ST201) This is for equalizing the distance of conveyance of the printing paper per one register pulse to the distance of rotation of the printing drum 10 per one drum pulse. For this purpose, the following formula should be satisfied;

$$2\pi Rd/Nd=\lambda'(2\pi Rm/Nm)\rightarrow P_{m,i}=\lambda P_{di}$$

wherein Rd represents the radius of the printing drum, Rm represents the radius of the register roller 52, Nd represents the resolution of the drum encoder, Nm represents the resolution of the register encoder, λ' represents a ($P_{m,i}\rightarrow P_{d,i}$) conversion coefficient and π represents a ($P_{d,i}\rightarrow P_{m,i}$) conversion coefficient (λ=1/λ')

Then the register motor 56 is controlled so that the register pulses $P_{m,i}$ are generated for each rising step in a number which, when multiplied by the register pulse $P_{m,i}$, produces a value equal to the product of the number (W) of the converted drum pulses $\lambda P_{d,i}$ in the rising step and the register roller rising ratio k/n2. At this time, the frequency of the converted drum pulses $\lambda P_{d,i}$ is used as a rotating speed signal $\nu_{d,i}$ representing the rotating speed of the printing drum 10 and the number of the converted drum pulses $\lambda P_{d,i}$ is used as an angular position signal $\theta_{d,i}$ representing the angular position of the printing drum 10. The frequency of the register pulses $P_{m,i}$ is used as a rotating speed signal $v_{m,i}$ representing the rotating speed of the register motor 56 and the number of the register pulses $P_{m,i}$ is used as an angular position signal $\theta_{m,i}$ representing the angular position of the register motor 56. (step ST201)

When the angular position of the register motor 56 is represented by $\theta_{m,i}$[pulse], the target angular position of the register motor 56 to which the register motor 56 is to be rotated is represented by $\theta_{d,i}$[pulse], the speed control gain, i.e., the torque [N·m] which the register motor 56 generates per 1[pulse/s] is represented by Kn[N·m·s/pulse] and the position control gain, i.e., the torque [N·m] which the register motor 56 generates per 1[pulse] is represented by Kn[N·m·1/pulse], the torque to be generated by the register motor 56 $T_{i+1}$[N·m] is represented by the following formula.

$$T_{i+1}[N\cdot m]=Kn\cdot d(\theta_{d,i}-\theta_{m,i})/dt+Kp\cdot(\theta_{d,i}-\theta_{m,i})$$

Then the position difference $\Delta\theta_i(=\theta_{d,i}-\theta_{m,i})$ between the target angular position $\theta_{d,i}$ of the register motor 56 and the present angular position $\theta_{m,i}$ of the register motor 56 and the rotating speed difference $\Delta v_i(=d(\theta_{d,i}-\theta_{m,i})/dt=v_{d,i}-v_{m,i})$ are calculated (step ST202) and $Kn\cdot\Delta v_i+Kp\cdot\Delta v_i$ is calculated as an output torque command $T_{i+1}$ (step ST203) until the time point F1 (FLG3=0). After the time point F1 (FLG3=1), $Kn\cdot\Delta v_i$ is calculated as an output torque command $T_{i+1}$ (step ST500).

That is, until the time point F1 (NX=NF1), the motor control circuit 140 controls the register motor 56 by way of the PWM signal generator 150 and the motor drive circuit 160 on the basis of the output torque command $T_{i+1}$ $(Kn\cdot\Delta v_i+Kp\cdot\Delta\theta_i)$ so that the register motor 56 is in a predetermined relation with the printing roller 10 with respect to the rotating speed and the angular position.

Thus the register motor 56 is accelerated to the rotating speed of the printing drum 10 while incrementing the number i of the drum pulses one by one (steps ST204 and ST205) and when the printing drum 10 is rotated to a position where the point G is just below the master sensor 30 (FIG. 3) (time point G), the register motor 56 is stopped (steps ST204 and ST206).

At the time point F1, the arrival flag FLG3 is set to 1 (step ST601) and after the time point F1, the motor control circuit 140 controls the register motor 56 by way of the PWM signal generator 150 and the motor drive circuit 160 independently from the rotating speed of the printing drum 10 on the basis of the output torque command $T_{i+1}$ $(Kn\cdot\Delta v_i)$, which does not include a position component, so that the rotating speed of the register rollers 51 and 52 is fixed to the target speed set in the target speed control (step ST401). At the target speed of the register motor 56, the peripheral speed of the register rollers 51 and 52 is lower than that of the printing drum 10. However the actual rotating speed (peripheral speed) of the register rollers 51 and 52 tends to approach that of the printing drum 10 since the conveying force of the printing drum 10 and the press roller 81 prevails over that of the register rollers 51 and 52 and forces the register rollers 51 and 52 to rotate at a higher speed by way of the printing paper so long as the trailing end portion of the printing paper is still between the register rollers 51 and 52. Accordingly, a difference $\Delta v$ is generated between the target speed and the actual rotating speed of the register motor 56 and the register motor 56 is controlled to produce a minus torque $\Delta v\cdot Kn$ (<0) so that the difference $\Delta v$ is kept constant. The minus torque acts on the register rollers 51 and 52 as a braking force and a back tension, which is substantially constant so long as $\Delta v\cdot Kn$ is constant, is applied to the printing paper. Accordingly, the printing paper can be stably conveyed and the printing paper and the stencil master M are prevented from being wrinkled. Further the stencil master M can be prevented from being shifted on the printing drum 10 due to unstable back tension. Further since the register motor 56 is controlled on the basis of the position difference $\Delta\theta_i$ and the rotating speed difference $\Delta v_i$, position shift of the printing paper due to fluctuation in the rotating speed of the printing drum 10 and/or register rollers 51 and 52 can be prevented.

Figure 9:
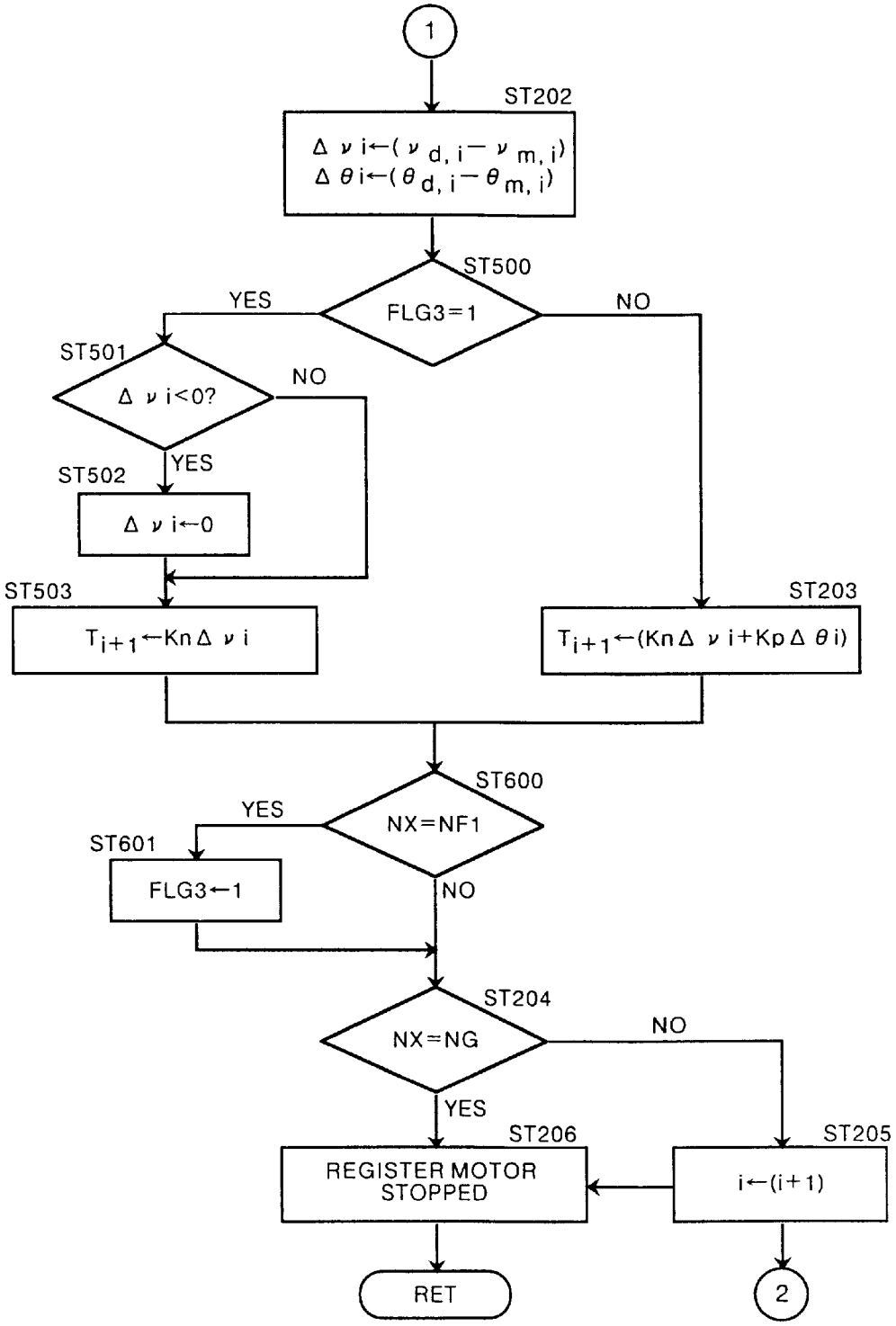
FIG. 9 is a flow chart for illustrating the register motor control processing in a stencil printer in accordance with another embodiment of the present invention.

A stencil printer in accordance with another embodiment of the present invention will be described with reference to FIG. 9, hereinbelow. The stencil printer of this embodiment differs from that of the preceding embodiment in that the register motor 56 is stopped after the time point F1 so that the register rollers 51 and 52 are driven by the printing drum 10 and the press roller 81 by way of the printing paper instead of being decelerated to a target speed. The flow chart shown in FIG. 9 is substantially the same as that shown in FIGS. 7 and 8 except that steps ST501 and ST502 are executed before step ST503. The rotating speed difference $\Delta v_i$ is calculated in step ST202 and when the rotating speed difference $\Delta v_i$ is minus after the time point F1, 0 is substituted for $\Delta v_i$ (steps ST501 and ST502) and accordingly the output torque command $T_{i+1}$ is nullified (step ST503).

When the register motor 56 is stopped, torque required to rotate the register motor 56 by way of the register rollers 51 and 52 acts as load on the printing paper, whereby back tension is applied to the printing paper and the same effect as in the preceding embodiment can be obtained.

What is claimed is:

1. A stencil printer comprising a rotary printing drum which is provided with a master clamp mechanism for holding an end of a stencil master and around which the stencil master is wrapped, a printing drum drive means which rotates the printing drum, a press roller which is rotatable in parallel to the printing drum in contact with the printing drum, a pair of opposed conveyor rollers which feed a printing paper between the printing drum and the press roller, a conveyor roller drive means which is provided separately from the printing drum drive means and drives at least one of the conveyor rollers, a printing drum rotation detecting means which detects the rotating speed of the printing drum;

a conveyor roller rotation detecting means which detects the rotating speed of at least one of the conveyor rollers, and a conveyor roller control means which controls the conveyor roller drive means on the basis of the rotation of the printing drum detected by the printing drum rotation detecting means and the rotation of the conveyor roller detected by the conveyor roller rotation detecting means, wherein the conveyor roller control means controls, when the leading end of the printing paper reaches a vicinity of the contact line of the printing drum and the press roller, the conveyor roller drive means to drive the conveyor rollers at a target rotating speed which is lower than the rotating speed of the printing drum detected by the printing drum rotation detecting means and is set so that the difference between the actual rotating speed of the conveyor roller detected by the conveyor roller rotation detecting means and the target rotating speed of the conveyor rollers is kept substantially constant.

2. A stencil printer comprising a rotary printing drum which is provided with a master clamp mechanism for holding an end of a stencil master and around which the stencil master is wrapped, a printing drum drive means which rotates the printing drum, a press roller which is rotatable in parallel to the printing drum in contact with the printing drum, a pair of opposed conveyor rollers which feed a printing paper between the printing drum and the press roller, a conveyor roller drive means which is provided separately from the printing drum drive means and drives at least one of the conveyor rollers, a printing drum rotation detecting means which detects the rotating speed of the printing drum, a conveyor roller rotation detecting means which detects the rotating speed of at least one of the conveyor rollers, and a conveyor roller control means which controls the conveyor roller drive means on the basis of the rotation of the printing drum detected by the printing drum rotation detecting means and the rotation of the conveyor roller detected by the conveyor roller rotation detecting means, wherein the conveyor roller control means stops the conveyor roller drive means when the leading end of the printing paper reaches a vicinity of the contact line of the printing drum and the press roller and maintains a load on said at least one of the conveyor rollers.

* * * * *